US009786983B2

(12) United States Patent
Yoshino et al.

(10) Patent No.: US 9,786,983 B2
(45) Date of Patent: Oct. 10, 2017

(54) ANTENNA DEVICE

(71) Applicant: Sony Corporation, Tokyo (JP)

(72) Inventors: Yoshitaka Yoshino, Tokyo (JP); Tomomichi Murakami, Tokyo (JP); Satoru Tsuboi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/364,318

(22) PCT Filed: Dec. 11, 2012

(86) PCT No.: PCT/JP2012/082049

§ 371 (c)(1),
(2) Date: Jun. 11, 2014

(87) PCT Pub. No.: WO2013/099589

PCT Pub. Date: Jul. 4, 2013

(65) Prior Publication Data

US 2014/0333493 A1 Nov. 13, 2014

(30) Foreign Application Priority Data

Dec. 28, 2011 (JP) ..... 2011-289197

(51) Int. Cl.
*H01Q 1/32* (2006.01)
*H01Q 1/08* (2006.01)
(Continued)

(52) U.S. Cl.
CPC ..... *H01Q 1/32* (2013.01); *H01Q 1/084* (2013.01); *H01Q 1/1271* (2013.01);
(Continued)

(58) Field of Classification Search
CPC .. H01Q 1/32; H01Q 1/48; H01Q 1/50; H01Q 1/52; H01Q 1/084; H01Q 1/3233; H01Q 1/3291; H01Q 1/1271
See application file for complete search history.

(56) References Cited

U.S. PATENT DOCUMENTS 5,629,712 A * 5/1997 Adrian ..... H01Q 1/3275 343/713
5,959,586 A 9/1999 Benham et al.
(Continued)

FOREIGN PATENT DOCUMENTS

CN 102237564 A 11/2011
JP 59-012059 U 1/1984
(Continued)

OTHER PUBLICATIONS

Chinese Office Action and English translation thereof issued Mar. 4, 2016 in connection with Chinese Application No. 201280063591.6.
(Continued)

*Primary Examiner* — Trinh Dinh
(74) *Attorney, Agent, or Firm* — Wolf, Greenfield & Sacks, P.C.

(57) ABSTRACT

Provided is an antenna device including an antenna element configured to receive a broadcast wave and a signal that is superimposed on the broadcast wave and then is transmitted, a ground element having a predetermined length, the ground element being configured to be capable of adjusting a relative position with respect to the antenna element, and a feeding part to which the antenna element and the ground element are connected and from which the signal received by the antenna element is taken out.

9 Claims, 12 Drawing Sheets

(51) Int. Cl.

| | |
|---|---|
| ***H01Q 1/48*** | (2006.01) |
| ***H01Q 1/52*** | (2006.01) |
| ***H01Q 9/38*** | (2006.01) |
| ***H01Q 1/50*** | (2006.01) |
| ***H01Q 5/40*** | (2015.01) |
| ***H01Q 1/12*** | (2006.01) |

(52) U.S. Cl.
CPC ..... *H01Q 1/3233* (2013.01); *H01Q 1/3291* (2013.01); *H01Q 1/48* (2013.01); *H01Q 1/50* (2013.01); *H01Q 1/52* (2013.01); *H01Q 5/40* (2015.01); *H01Q 9/38* (2013.01)

(56) References Cited

U.S. PATENT DOCUMENTS

| | | | | |
|---|---|---|---|---|
| 6,005,527 | A * | 12/1999 | Gomez | H01Q 1/1271 343/711 |
| 6,362,784 | B1 | 3/2002 | Kane et al. | |
| 7,852,272 | B2 * | 12/2010 | Imano | H01Q 1/242 343/702 |
| 8,487,827 | B2 | 7/2013 | Mukai et al. | |
| 8,780,011 | B2 | 7/2014 | Yoshino et al. | |
| 9,490,546 | B2 | 11/2016 | Yoshino et al. | |
| 2005/0009589 | A1 * | 1/2005 | Oouchi | H01Q 1/084 455/575.9 |
| 2007/0097001 | A1 | 5/2007 | Sugimoto et al. | |
| 2008/0300029 | A1 * | 12/2008 | Liu | H01Q 9/42 455/575.3 |
| 2010/0238088 | A1 | 9/2010 | Mukai et al. | |
| 2010/0245185 | A1 | 9/2010 | Mukai et al. | |
| 2010/0309083 | A1 | 12/2010 | Su | |
| 2011/0037668 | A1 | 2/2011 | Mukai et al. | |
| 2011/0057847 | A1 * | 3/2011 | Iwai | H01Q 1/243 343/702 |
| 2012/0050133 | A1 | 3/2012 | Yoshino et al. | |
| 2013/0009835 | A1 | 1/2013 | Yoshino et al. | |
| 2015/0055020 | A1 | 2/2015 | Yoshino et al. | |
| 2015/0200464 | A1 | 7/2015 | Yoshino et al. | |
| 2016/0372814 | A1 * | 12/2016 | Murakami | H01Q 1/084 |

FOREIGN PATENT DOCUMENTS

| | | | |
|---|---|---|---|
| JP | 04-49423 | U | 4/1992 |
| JP | 05-283921 | A | 10/1993 |
| JP | 08-008625 | A | 1/1996 |
| JP | 11-017595 | A | 1/1999 |
| JP | 11-122021 | A | 4/1999 |
| JP | 2000-156608 | A | 6/2000 |
| JP | 2000-216613 | A | 8/2000 |
| JP | 2001-251120 | A | 9/2001 |
| JP | 2004-208208 | A | 7/2004 |
| JP | 3580245 | B2 | 10/2004 |
| JP | 2005-142658 | A | 6/2005 |
| JP | 3127558 | U | 7/2006 |
| JP | 4412137 | B2 | 2/2010 |
| WO | WO 2011/118436 | A1 | 9/2011 |

OTHER PUBLICATIONS

U.S. Appl. No. 14/898,940, filed Dec. 16, 2015, Murakami et al.
U.S. Appl. No. 15/277,699, filed Sep. 27, 2016, Yoshino et al.

* cited by examiner

CONFIGURATION EXAMPLE OF ONBOARD ANTENNA ACCORDING TO FIRST EMBODIMENT

A

B

| | VERTICALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -12.19 | -10.35 | -13.34 | -11.85 | -9.44 | -12.14 | -17.10 | -15.17 |

C

| | HORIZONTALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -4.19 | -2.95 | -3.63 | -8.32 | -7.84 | -7.14 | -10.30 | -10.30 |

CONFIGURATION EXAMPLE OF ANTENNA ACCORDING TO MODIFIED EXAMPLE 1 OF FIRST EMBODIMENT

A

B

| | VERTICALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -11.52 | -11.26 | -10.83 | -11.18 | -8.24 | -8.99 | -15.90 | -10.37 |

C

| | HORIZONTALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -3.39 | -1.86 | -1.43 | -5.58 | -5.39 | -3.96 | -6.30 | -5.92 |

CONFIGURATION EXAMPLE OF ANTENNA ACCORDING TO MODIFIED EXAMPLE 2 OF FIRST EMBODIMENT

A

B

| | VERTICALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -11.59 | -12.26 | -13.03 | -9.85 | -7.04 | -7.79 | -15.70 | -14.97 |

C

| | HORIZONTALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -2.79 | -1.75 | -1.54 | -4.58 | -3.48 | -2.19 | -8.70 | -7.57 |

CONFIGURATION EXAMPLE OF ANTENNA ACCORDING TO MODIFIED EXAMPLE 3 OF FIRST EMBODIMENT

CONFIGURATION EXAMPLE OF ANTENNA ACCORDING TO SECOND EMBODIMENT

CONFIGURATION EXAMPLE ACCORDING TO MODIFIED EXAMPLE OF ANTENNA OF SECOND EMBODIMENT

A

B

| | VERTICALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -10.99 | -8.46 | -9.65 | -8.38 | -4.64 | -4.19 | -12.30 | -11.66 |

C

| | HORIZONTALLY POLARIZED WAVE | | | | | | | |
|---|---|---|---|---|---|---|---|---|
| FREQUENCY[MHz] | 470 | 520 | 570 | 620 | 670 | 720 | 770 | 906 |
| PEAK GAIN[dBd] | -5.59 | -2.15 | -0.54 | -3.18 | -4.04 | -2.16 | -5.10 | -8.81 |

ANTENNA DEVICE

CROSS REFERENCES TO RELATED APPLICATIONS

The present application is a National Stage of International Application No. PCT/JP2012/082049, filed on Dec. 11, 2012, which claims the priority benefit of Japanese Patent Application Number 2011-289197, filed in the Japanese Patent Office on Dec. 28, 2011.

TECHNICAL FIELD

The present disclosure relates to an antenna device suitable to receive a broadcast signal in a moving object, such as a vehicle.

BACKGROUND ART

Conventionally, as an antenna for a car navigation device installed in a vehicle and a PND (Personal Navigation Device) attached to a vehicle, a rod antenna attached outside a vehicle or a film antenna that can be bonded to the windshield or the rear glass is used frequently.

In the case where a moving object, such as a vehicle, receives a broadcast, due to the influence of fading, the signal level of the received signal varies considerably, and therefore, diversity reception is performed frequently for the purpose of making up the deterioration in the received signal due to the influence of fading. However, in order to perform diversity reception, it is necessary to provide a plurality of antennas.

Because of this, as an antenna for performing diversity reception, the film antenna that hardly affects the external appearance is selected more frequently than the rod antenna that mars the external appearance because the number of antennas increases.

For example, in Patent Literature 1, the technique to enable stable reception of the broadcast wave by installing a film antenna on four surfaces, i.e. the front, rear, left, and right surfaces of a vehicle.

CITATION LIST

Patent Literature

Patent Literature 1: JP H11-017595A

SUMMARY OF INVENTION

Technical Problem

However, it is difficult to attach a film antenna to a window, and therefore, it is necessary for a user to ask an expert to perform attachment in order to bond the film antenna to an appropriate position in a favorable manner. In such a case, a user needs to pay for the work for attachment, besides the expense for the film antenna.

Further, because the film antenna uses a member whose electric conductivity is not so good as an antenna element and the length of the antenna cable is long, the gain of the antenna is low compared to that of the rod antenna etc. In order to solve this problem, an amplifier is also used in many film antennas. However, if the amplifier is provided, there arise such problems that power consumption increases and that a dedicated connector is necessary.

An object of the present disclosure is to provide an antenna device excellent in reception performance and easy to attach.

Solution to Problem

The antenna device of the present disclosure includes an antenna element configured to receive a broadcast wave and a signal that is superimposed on the broadcast wave and then is transmitted, and a ground element having a predetermined length and configured so that the relative angle with respect to the antenna element can be adjusted. Further, there is provided a feeding part to which the antenna element and the ground antenna are connected and from which a signal received by the antenna element is taken out.

With this configuration, capacitive coupling occurs between the ground element and a metal portion of the vehicle body mounting an onboard antenna by adjusting the angle of the ground element with respect to the antenna element. Consequently, the area of the portion that functions as the ground of the antenna device for receiving a broadcast signal increases, and therefore, the reception characteristics of the antenna device improve. Further, the antenna device is formed only by arranging the antenna element and the ground element on, for example, the dashboard etc. of the vehicle body, and therefore, it is possible to extremely easily attach the antenna device.

Advantageous Effects of Invention

According to the present disclosure, there is provided an antenna device excellent in reception performance and easy to attach.

BRIEF DESCRIPTION OF DRAWINGS

FIGS. 2A to 2C are a graph and tables showing the frequency-gain characteristics in the UHF band of the onboard antenna according to the first embodiment of the present disclosure, in which FIG. 2A is a graph, FIG. 2B is a table showing the gain characteristics when vertically polarized waves are received, and FIG. 2C is a table showing the gain characteristics when vertically polarized waves are received.

FIGS. 3A and 3B are graphs showing the reception characteristics of the onboard antenna according to the first embodiment of the present disclosure, in which FIG. 3A is a graph showing the C/N ratio in the signal received by a conventional film antenna and FIG. 3B is a graph showing the C/N ratio in the signal received by the onboard antenna of the present disclosure.

FIGS. 6A to 6C are a graph and tables showing the frequency-gain characteristics in the UHF band of the onboard antenna according to the modified example 1 of the first embodiment of the present disclosure, in which FIG. 6A is a graph, FIG. 6B is a table showing the gain characteristics when vertically polarized waves are received, and FIG. 6C is a table showing the gain characteristics when vertically polarized waves are received.

FIGS. 8A to 8C are a graph and tables showing the frequency-gain characteristics in the UHF band of the onboard antenna according to the modified example 2 of the first embodiment of the present disclosure, in which FIG. 8A is a graph, FIG. 8B is a table showing the gain characteristics when vertically polarized waves are received, and FIG. 8C is a table showing the gain characteristics when vertically polarized waves are received.

FIGS. 12A to 12C are a graph and tables showing the frequency-gain characteristics in the UHF band of the onboard antenna according to the modified example of the second embodiment of the present disclosure, in which FIG. 12A is a graph, FIG. 12B is a table showing the gain characteristics when vertically polarized waves are received, and FIG. 12C is a table showing the gain characteristics when vertically polarized waves are received.

DESCRIPTION OF EMBODIMENTS

Hereinafter, preferred embodiments for embodying the present disclosure are described. Explanation is given in the order below.

1. First Embodiment Example (example in which an antenna element and a ground element are connected via a substrate)
2. Modified Example of First Embodiment
   - 2-1. Modified Example 1 of First Embodiment (example in which an antenna element is configured by a substrate)
   - 2-2. Modified Example 2 of First Embodiment (example in which an antenna element is configured by a substrate and a J-type antenna is configured by a ground part different from a ground element and the antenna element)
   - 2-3. Modified Example 3 of First Embodiment (example in which a plurality of antenna elements is provided and a connection part with a ground element is shared)
3. Second Embodiment Example (example in which a ground element is configured by a rod-shaped antenna)
   - 3-1. Modified Example of Second Embodiment (example in which a plurality of ground elements configured by a rod-shaped antenna is provided)
4. Various kinds of Modified Examples

1. First Embodiment Example

Figure 1:
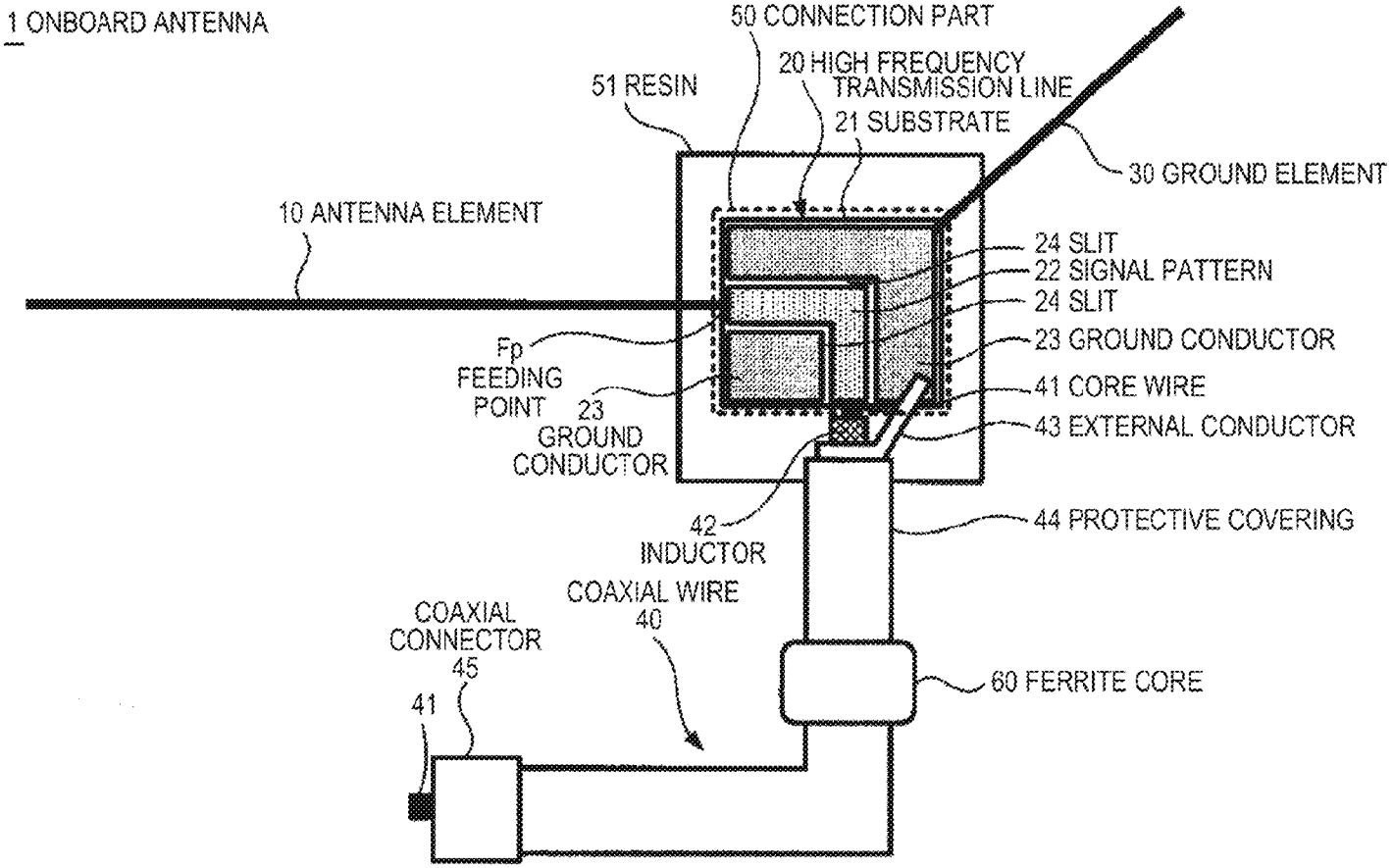
FIG. 1 is an explanatory diagram illustrating a configuration example of an onboard antenna according to a first embodiment of the present disclosure.

FIG. 1 is a schematic diagram illustrating a configuration example of an onboard antenna according to a first embodiment of the present disclosure. An onboard antenna 1 illustrated in FIG. 1 includes an antenna element 10, a high frequency transmission line 20, a ground element 30, and a coaxial wire 40 as an antenna cable. In the present embodiment, the antenna element 10 is configured by a conductive wire material, such as a metal rod, and the antenna element 10 is connected to a signal pattern (signal line) 22 of 5 the high frequency transmission line 20 configured by a ground-attached coplanar line. The coplanar line is a transmission line in which the signal line and the ground conductor exist on the same plane.

As described above, in the high frequency transmission line 20, the ground-attached coplanar line is used and on the surface of the substrate 21 configured by a plate-shaped dielectric, a signal pattern 22 and a ground conductor 23 are provided directly or via an insulating film. Between the signal pattern 22 and the ground conductor 23, a slit 24, which is a linear gap, is provided with an appropriate width. The ground conductor 23 is formed also on the backside of the substrate 21 and is connected with the ground conductor 23 on the top surface normally via a through hole etc. and is configured so as to function as a ground. By configuring the high frequency transmission line 20 by a ground-attached coplanar line, the dielectric loss by the substrate is suppressed low, and therefore, it is possible to allow the high frequency signal received by the antenna element 10 to pass without attenuation.

To the ground conductor 23 on the substrate 21, the ground element 30 configured by a conductive wire material, such as a metal rod, is connected. With this configuration, an antenna is configured by the antenna element 10 and the ground element 30. By setting the total length of the length of the antenna element 10 and the length of the ground element 30 to about $\lambda/2$ of the frequency desired to be received, it is made possible to receive the desired frequency by the onboard antenna 1. Actually, it is necessary to appropriately adjust the elements according to the material of the antenna element 10, the material of the ground element 30, and the reception frequency. In the present embodiment, for example, by setting the length of the antenna element 10 to 13 cm and that of the ground element 30 to 10 cm, the antenna is configured to be able to receive frequencies in the UHF band.

To the end portion of the signal pattern 22 on the substrate 21, on the opposite side of the side to which the antenna element 10 is connected, a core wire 41 of the coaxial wire 40 is connected and to the end portion of the ground conductor 23, an external conductor 43 of the coaxial wire 40 is connected. In other words, at the tip end portion of the coaxial wire 40, a protective covering 44 and the external conductor 43 are removed from the coaxial wire 40 to bring about a state where a dielectric 42 and the core wire 41 are exposed. A feeding point Fp of the onboard antenna 1 according to the present embodiment is a portion where the antenna element 10 protrudes in the leftward direction in FIG. 1 from the ground conductor 23. In other words, in the portion where the antenna element 10 and the signal pattern 22 are connected, the feeding point Fp is formed.

A connection part 50, which is the portion where the antenna element 10, the ground element 30, and the coaxial wire 40 are connected to the high frequency transmission line 20, is molded by a resin 51, such as elastomer. In other words, the resin 51 is formed so as to cover the substrate 21, the signal pattern 22, and the ground conductor 23. To the end portion of the coaxial wire 40, on the opposite side of the side connected to the connection part 50, a coaxial connector 45 is attached.

Further, a ferrite core 60 as a high frequency attenuating member is provided on a part of the coaxial wire 40. By providing the ferrite core 60, radio waves are not induced on the external conductor 43 of the coaxial wire 40 from the ferrite core 60 to the coaxial connector 45. Consequently, the image current and noise received by the antenna element 10 flow through the external conductor 43 from the connection part 50 to the ferrite core 60. In other words, this portion functions as the ground of the antenna element 10. Consequently, it is possible to prevent radio waves at frequencies not intended from being induced with the external conductor 43 of the coaxial wire 40 functioning as an antenna.

Further, because the portion that functions as the ground of the antenna extends, the reception characteristics of the antenna element 10 improve. It is assumed that the position on the coaxial wire 40 where the ferrite core 60 is provided (the distance from the connection part 50) can be adjusted to any position in accordance with the frequency etc. desired to be received. In the present embodiment, by providing the ferrite core 60 in the position 7 cm apart from the connection part 50, it is possible to remove the noise and image current that are induced on the antenna element 10 most efficiently.

Further, as described above, the feeding point Fp of the onboard antenna 1 is configured in the position where the signal pattern 22 of the substrate 21 and the antenna element 10 are connected. By adjusting the impedance of the feeding point Fp by the insertion position of the ferrite core 60 and the length of the antenna element 10, it is made possible to determine the reception frequency.

Figure 2:
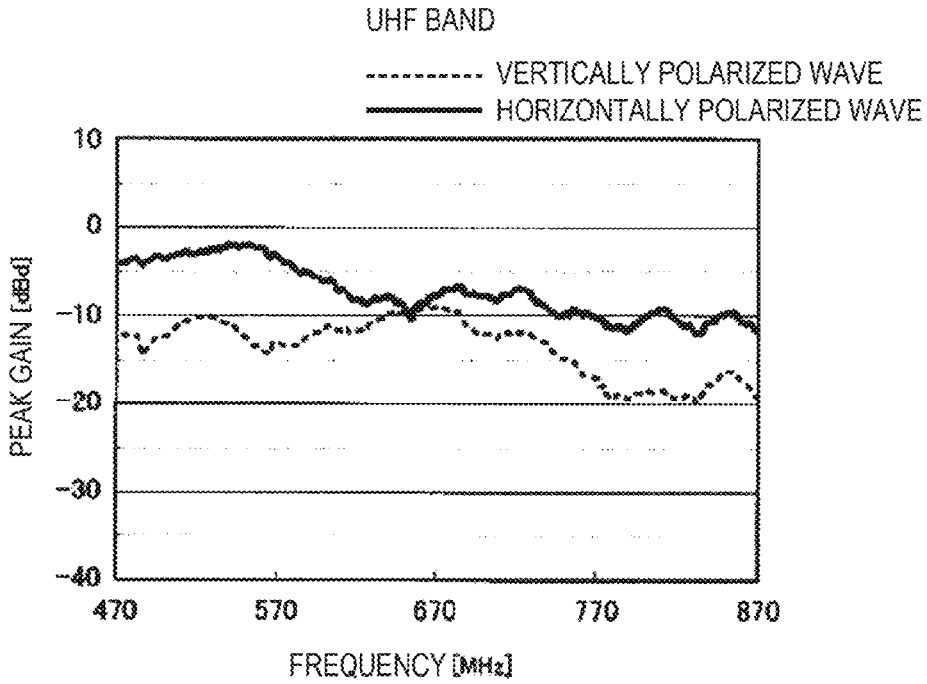

FIGS. 2A to 2C illustrate the frequency-gain characteristics when the onboard antenna 1 illustrated in FIG. 1 receives a broadcast in the UHF band. As the coaxial wire 40 illustrated in FIG. 1, one having a length of 3 m is used. FIG. 2A is a graph and FIG. 2B and FIG. 2C illustrate data. The horizontal axis in FIG. 2A represents the frequency (MHz) and the vertical axis represents the peak gain (dBd). The solid line in the graph represents the gain characteristics at the time of reception of horizontally polarized waves and the broken line represents the gain characteristics at the time of reception of vertically polarized waves. FIG. 2B is data indicative of the frequency-gain characteristics at the time of reception of vertically polarized waves and FIG. 2C is data indicative of the frequency-gain characteristics at the time of reception of horizontally polarized waves. As illustrated in FIG. 2A to FIG. 2C, in the UHF band of 470 MHz to 870 MHz, it was confirmed that the gain characteristics of about −10 dB or more were obtained in the horizontally polarized waves, i.e., the main polarized waves of a TV broadcast.

Figure 3:
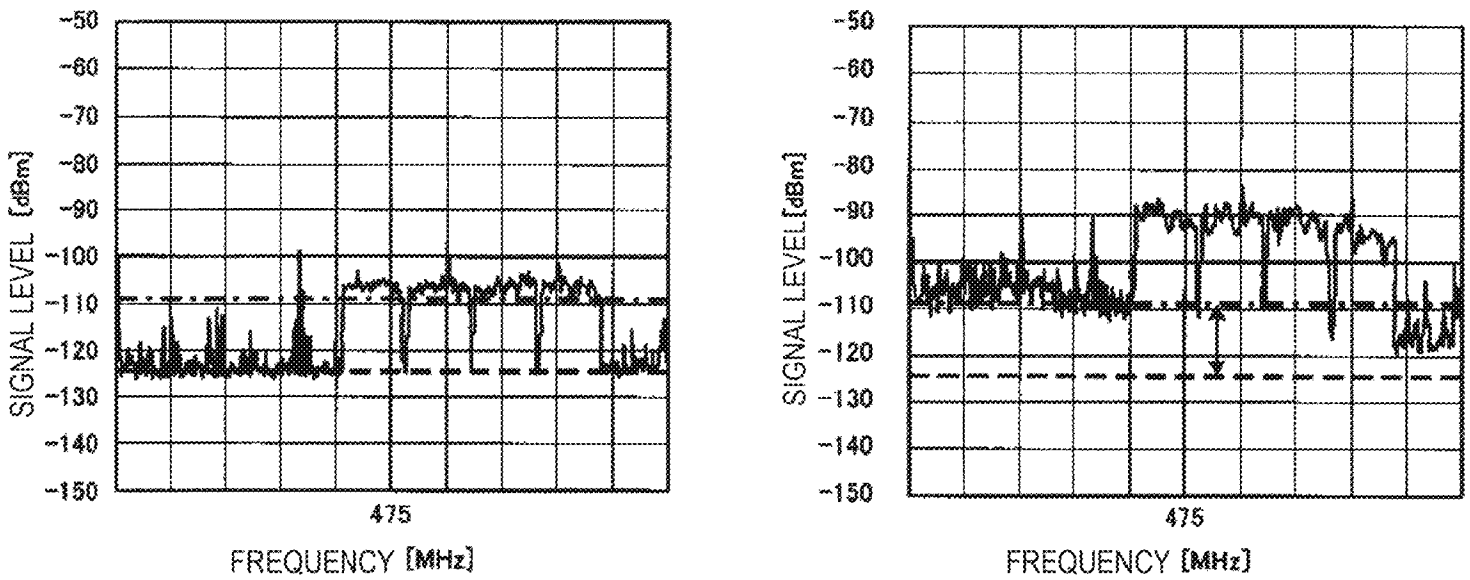

FIGS. 3A and 3B illustrate the C/N ratio (Carrier to Noise Ratio) in the received signal before demodulation by a comparison with that in the conventional film antenna. FIG. 3A is a graph showing the C/N ratio of the received signal in the case where the onboard antenna 1 receives the signal in the UHF band (center frequency is 475 MHz) and FIG. 3B is a graph showing the C/N ratio of the received signal in the case where the conventional film antenna receives the signal in the UHF band. As the conventional film antenna, one that uses an amplifier to increase the level of the received signal by 15 dB is used. In FIG. 3A and FIG. 3B, the horizontal axis represents the frequency (MHz) and the vertical axis represents the signal level (dBm).

As illustrated in FIG. 3A, in the signal received by the onboard antenna 1 according to the present embodiment, the noise floor is a value in the vicinity of −122 dBm as represented by the broken line and the signal level is a value in the vicinity of −105 dBm as represented by the alternately long and short dash line. In contrast to this, in the signal received by the conventional film antenna, the level of the signal is increased to the vicinity of −88 dBm as illustrated in FIG. 3B. However, it is known that together with the signal level, the noise floor is also increased to the vicinity of −108 dBm. In other words, in FIG. 3B, the C/N ratio indicated by the interval between the alternate long and short dash line representing the level of the noise floor and the broken line representing the signal level is not so much different from the C/N ratio in the onboard antenna 1 illustrated in FIG. 3A. At some frequencies, the C/N ratio in the onboard antenna 1 illustrated in FIG. 3A is somewhat better.

Figure 4:
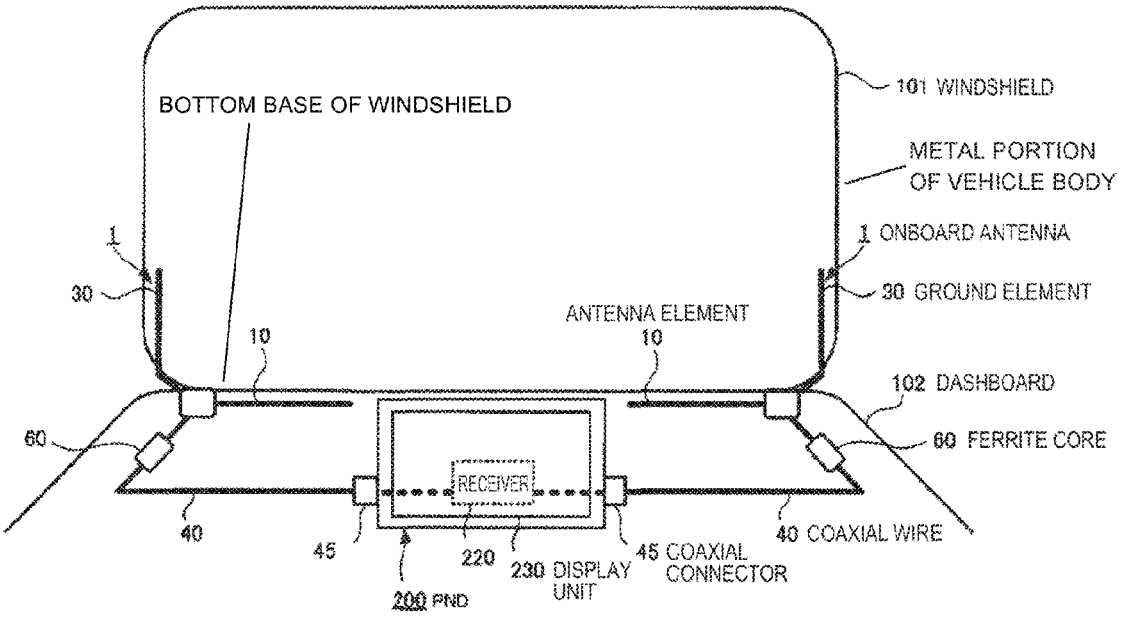
FIG. 4 is an explanatory diagram illustrating an arrangement example of the onboard antenna according to the first embodiment of the present disclosure.

FIG. 4 is a schematic diagram illustrating an arrangement example of the onboard antenna 1 to the vehicle body. In the case where the onboard antenna 1 receives a broadcast using a high-order modulation system, for example, such as a full-segment broadcast, it is possible to improve the reception characteristics of the antenna by providing the two onboard antennas 1 to perform diversity reception. FIG. 4 illustrates an example in which the two onboard antennas 1 are arranged at the right end and the left end, respectively, of a dashboard 102 in contact with the base of a windshield 101 of the vehicle. In the left and right onboard antennas 1, the antenna elements 10 are caused to extend straightforward so as to be parallel to the base of the windshield 101 on the dashboard 102 and the ground elements 30 are caused to extend along the left and right sides of the windshield 101.

The coaxial connector 45 provided at the tip end portion of each of the coaxial wires 40 of the left and right onboard antennas 1 is attached to a PND 200. Inside the PND 200, a receiver 210 is configured and the receiver 210 performs diversity reception and demodulates a received signal. In the present embodiment, as the diversity reception, for example, the maximum ratio combining system of the spatial diversity is used. The signal demodulated by the receiver 210 is displayed on the screen of a display unit 220 including a liquid crystal display etc.

By arranging the onboard antenna 1 in this manner, the metal body of the vehicle located at the end of the windshield 101 and the ground element 30 of the onboard antenna 1 are capacitively coupled and the ground of the antenna is extended. Consequently, the level of the signal received by the onboard antenna 1 increases and further, the reception characteristics at the time of running also improve.

According to the onboard antenna 1 of the present embodiment, by the capacitive coupling of the ground element 30 and the metal portion of the vehicle body, the portion of the antenna that functions as the ground is extended, and therefore, it is made possible to obtain the reception characteristics equal to or more than those of the conventional film antenna. Further, it is not necessary to bond the antenna to the windshield 101 or the rear glass (not illustrated), and therefore, it is made possible to use a metal member having an excellent electric conductivity as the raw material of the antenna element 10. Furthermore, it is no longer necessary to dispose the antenna in the position apart from the car navigation device or the PND 200, such as the upper end of the windshield 101 and the rear glass, not illustrated, and therefore, it is also possible to reduce the length of the antenna cable (the coaxial wire 40).

Consequently, it is no longer necessary to provide an amplifier to make up for the antenna gain that reduces resulting from the material of the antenna element and the cable length. Consequently, it is no longer necessary to use an expensive connector, such as the MCX connector compatible with the amplifier, and therefore, it is possible to reduce the manufacturing cost. Besides that, power consumption can be also suppressed. Further, the onboard antenna 1 according to the present embodiment only needs to be disposed on the dashboard 102, and therefore, it is possible for a user to easily perform attachment by him/herself. Consequently, it is no longer necessary for a user to pay the attachment expense.

Further, it is easy to increase the number of antennas, and therefore, it is possible to perform diversity reception. Consequently, it is made possible to receive a full-segment broadcast, and therefore, it is made possible to clearly display characters and videos of high precision even in the device whose screen size is comparatively large, such as the PND 200. Further, even in the case where the number of onboard antennas 1 is increased in order to perform diversity reception, the onboard antenna 1 is not disposed on the surface of the windshield 101, and therefore, the visibility at the time of driving is no longer blocked. Furthermore, it is not necessary to attach the antenna outside the vehicle body, and therefore, the external appearance of the vehicle is no longer marred.

In the embodiment described above, the antenna element 10 and the ground element 30 of the onboard antenna 1 are disposed on the dashboard 102 of the vehicle, but they may be fixed by a damper etc.

Further, in the embodiment described above, the antenna element 10 and the ground element 30 are connected via the high frequency transmission line 20 configured by a ground-attached coplanar line, but this is not limited. Another high frequency transmission line, such as a microstrip line, may be used. Alternatively, the antenna element 10 and the ground element 30 may be connected directly to the coaxial wire 40 without using the high frequency transmission line 20. In this case, the antenna element 10 is connected to the core wire 41 of the coaxial wire 40 and the ground element 30 is connected to the external conductor 43 of the coaxial wire 40.

In the arrangement example illustrated in FIG. 4, the example is given in which the two onboard antennas 1 are provided in order to perform diversity reception, but another number of onboard antennas 1 may be provided, such as four. Application is available also in the case where diversity reception is not performed and in such a case, only one onboard antenna 1 is used.

2. Modified Example of First Embodiment Example

Next, a configuration example of an onboard antenna 1A according to a modified example of the first embodiment described above is explained with reference to FIG. 5 to FIG. 9.

2-1. Modified Example 1

Figure 5:
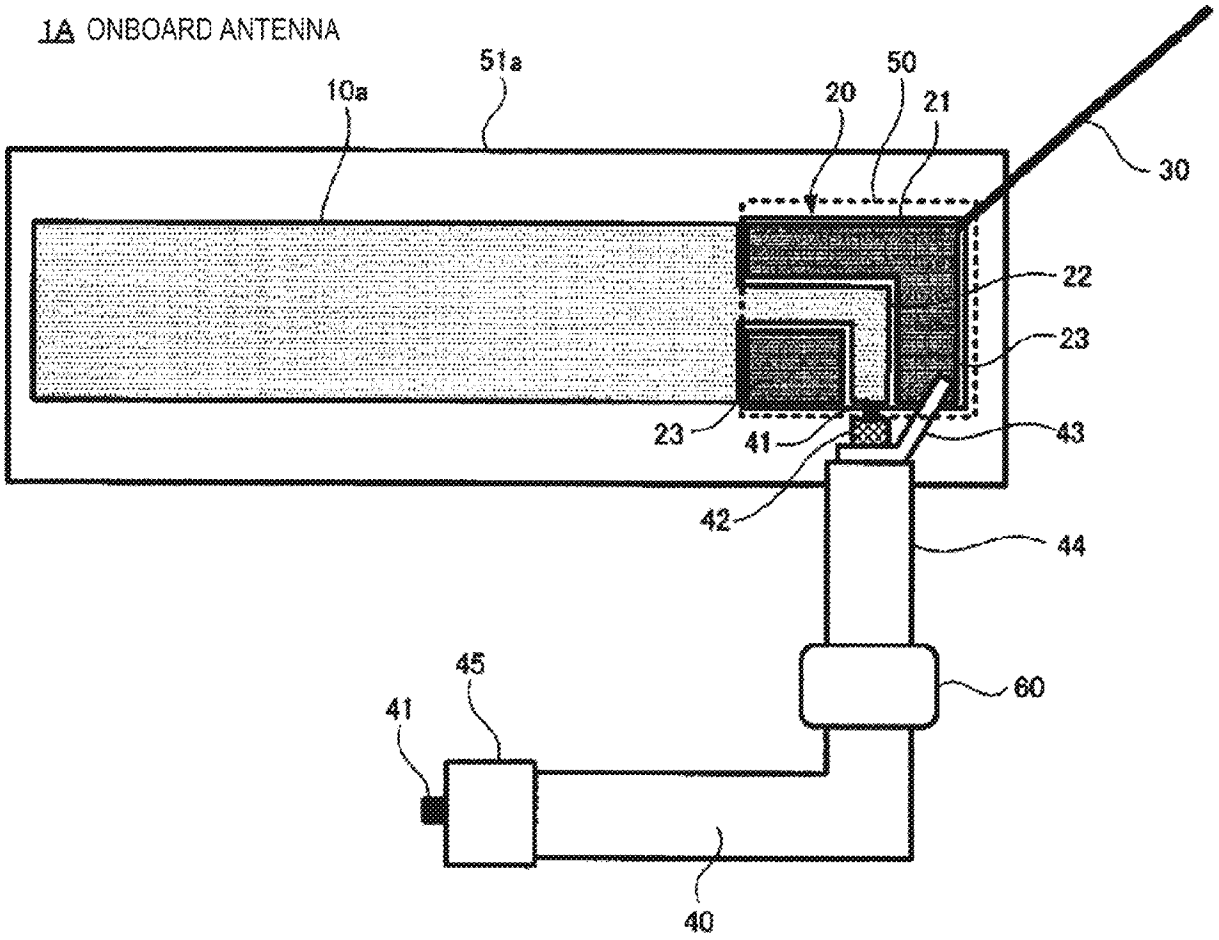
FIG. 5 is an explanatory diagram illustrating a configuration example of an onboard antenna according to a modified example 1 of the first embodiment of the present disclosure.
Figure 6:
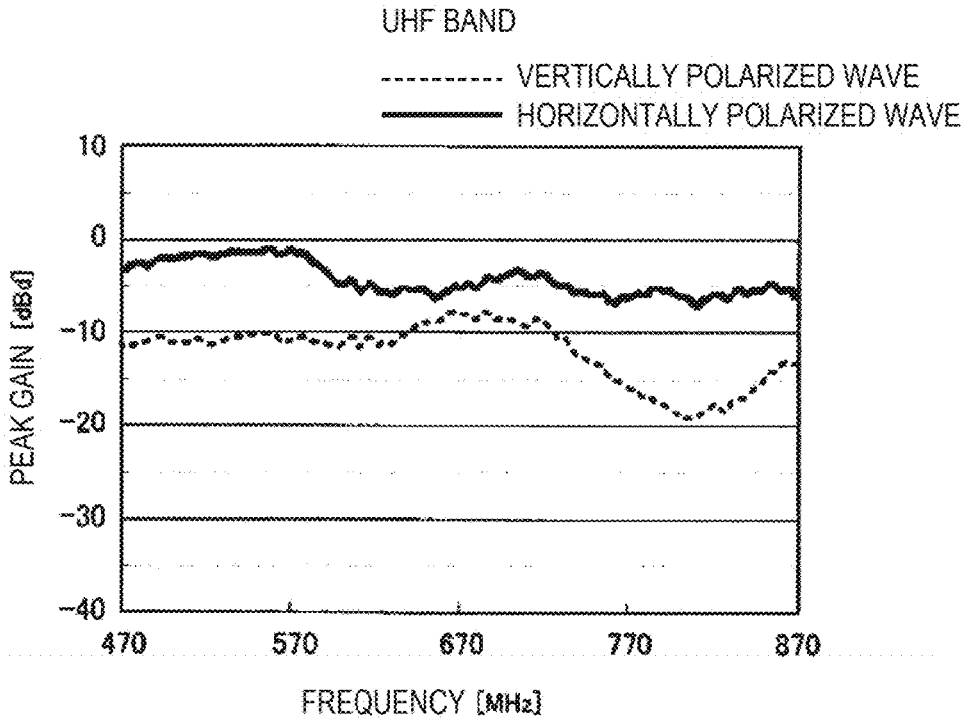

FIG. 5 is a schematic diagram illustrating a configuration example of a modified example 1. In FIG. 5, the same symbols are attached to the portions corresponding to those in FIG. 1 and duplicated explanation is omitted. The onboard antenna 1A illustrated in FIG. 5 differs from the onboard antenna 1 illustrated in FIG. 1 in that an antenna element 10*a* is configured by a substrate made of a plate-shaped conductor.

Specifically, the width is set to the same width from the end to the end of the two ground conductors 23 (e.g., 15 mm) and the length in the longitudinal direction is set to 115 mm. A substrate having no ground provided on the backside is connected with the end portion of the signal pattern 22 on the substrate 21. The end portion of the signal pattern 22 on the substrate 21 refers to the side to which the core wire 41 of the coaxial wire 40 or the ground element 30 is not connected. With this configuration, it is possible to increase the area of the antenna element 10*a* more than that of the onboard antenna 1 explained as the first embodiment. In the present embodiment, the portion where the antenna element 10*a* and the substrate 21 are connected is covered by a resin case 51*a*.

FIGS. 6A to 6C are a graph and tables showing the frequency-gain characteristics when the onboard antenna 1A of the present embodiment receives a broadcast in the UHF band. The length of the coaxial wire 40 is set to 1.5 m. FIG. 6A is a graph and FIG. 6B and FIG. 6C illustrate data. The horizontal axis in FIG. 6A represents the frequency (MHz) and the vertical axis represents the peak gain (dBd). The solid line in the graph represents the gain characteristics at the time of reception of horizontally polarized waves and the broken line represents the gain characteristics at the time of reception of vertically polarized waves. FIG. 6B is data indicative of the frequency-gain characteristics at the time of reception of vertically polarized waves and FIG. 6C is data indicative of the frequency-gain characteristics at the time of reception of horizontally polarized waves. As illustrated in FIG. 6A to FIG. 6C, particularly in the band of 570 MHz to 770 MHz, it was confirmed that the gain characteristics of about −10 dB or more were obtained both in the vertically polarized waves and in the horizontally polarized waves. In other words, it is known that the reception characteristics are improved considerably compared to the gain characteristics (see FIGS. 2A to 2C) in the onboard antenna 1 explained as the first embodiment.

Here, the example is given in which the width of the antenna element 10*a* is set to the same width from the end to the end of the ground conductor 23, but this is not limited. The width may be made wider than this and if widened, currents at various frequencies flow through the antenna element 10*a*, and therefore, it is possible to further improve the reception characteristics particularly on the high frequency side.

2-2. Modified Example 2

Figure 7:
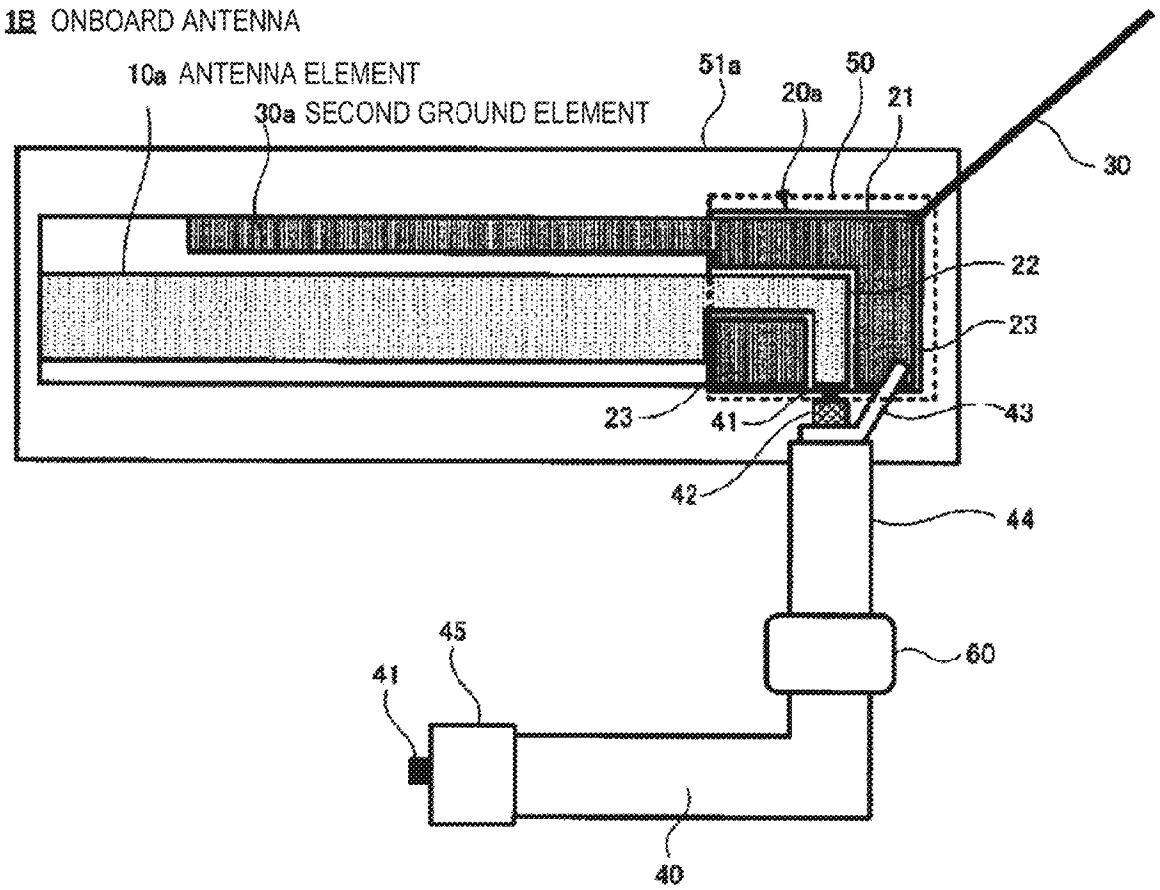
FIG. 7 is an explanatory diagram illustrating a configuration example of an onboard antenna according to a modified example 2 of the first embodiment of the present disclosure.
Figure 8:
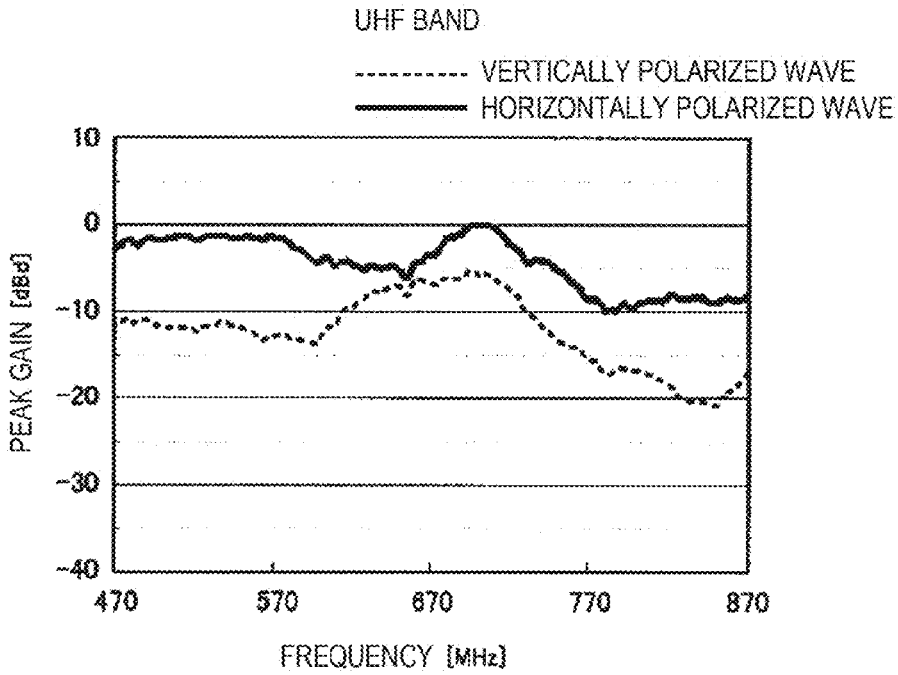

FIG. 7 is a schematic diagram illustrating a configuration example of a modified example 2 of the first embodiment of the present disclosure. In FIG. 7, the same symbols are attached to the portions corresponding to those in FIG. 1 and FIG. 6 and duplicated explanation is omitted. An onboard antenna 1B illustrated in FIG. 7 differs from the onboard antenna 1A illustrated in FIG. 6 in that the ground conductor 23 on the substrate 21 is extended and a second ground element 30*a* different from the ground element 30 is provided.

The second ground element 30*a* is disposed in parallel to an antenna element 10*b* and separate from the antenna element 10*a* by a predetermined interval, and the length in the longitudinal direction thereof is made shorter than the length of the antenna element 10*b*. With this configuration, a J-type antenna is configured by the antenna element 10*a* and the second ground element 30*a*.

By adjusting the length of the second ground element 30*a* and the distance from the antenna element 10*a*, an image current at the frequency received by the antenna element 10*a* begins to flow through the second ground element 30*a*. Consequently, it is made possible to take out the sum of the signal of the desired wave and the image current as a received signal at the feeding point Fp, and therefore, it is possible to increase the level of the received signal. In other words, it is possible to improve the reception sensitivity of the antenna. As specific dimensions, for example, in the case where a signal in the UHF band is received, the length and width of the antenna element 10*a* are set to 130 mm and 8 mm respectively, and the length and width of the second ground element 30*a* are set to 85 mm and 3 mm respectively. Then, the interval between the antenna element 10*a* and the second ground element 30*a* is set so that signals received by the antenna element 10*a* and the second ground element 30*a* respectively can be isolated from each other.

FIGS. 8A to 8C are a graph and tables showing the frequency-gain characteristics when the onboard antenna 1B of the present embodiment receives a broadcast in the UHF band. The length of the ground element 30 is set to 100 mm and the length of the coaxial wire 40 is set to 1.5 m. FIG. 8A is a graph and FIG. 8B and FIG. 8C illustrate data. The horizontal axis in FIG. 8A represents the frequency (MHz) and the vertical axis represents the peak gain (dBd). The solid line in the graph represents the gain characteristics at the time of reception of horizontally polarized waves and the broken line represents the gain characteristics at the time of reception of vertically polarized waves. FIG. 8B is data indicative of the frequency-gain characteristics at the time of reception of vertically polarized waves and FIG. 8C is data indicative of the frequency-gain characteristics at the time of reception of horizontally polarized waves. As illustrated in FIG. 8A to FIG. 8C, in the portion of high frequencies particularly around 670 MHz to 750 MHz, it was confirmed that the gain characteristics of −8 dB or more were obtained both in the vertically polarized waves and in the horizontally polarized waves. Particularly in the horizontally polarized waves, the favorable characteristics of −5 dB or more are obtained. In other words, it is known that the reception characteristics are improved considerably compared to the gain characteristics in the onboard antenna of each embodiment described above.

For the onboard antenna 1B of the present embodiment, a field test to evaluate the running characteristics was also conducted. The field test was conducted by attaching both the conventional film antenna and the onboard antenna 1B of the present embodiment to one vehicle and by running through areas where the electric field was weak and areas behind buildings where radio waves were weak and affected by fading. Then, by watching and listening to the videos of the predetermined broadcast wave received by the two antennas, respectively, how the block noise appeared in the video was checked. In other words, the lengths of intervals at which block noise was generated, the way the generated block noise appeared, etc., were compared. The east end of the area where the filed test was conducted is around Ishikawadai, Ohta-ku, Tokyo about 10 km apart from the Tokyo tower from which the broadcast wave are transmitted, and the west end is around the Musashishinjo, Nakahara-ku, Kawasaki-shi, about 5 km apart from the east end in the south-west direction. The north end is around Todoroki, Setagaya-ku, and the south end is around Shinmaruko, Nakahara-ku, Kawasaki-shi.

As the film antenna, two antennas were provided in order to perform diversity reception and the antennas were bonded to the upper-right portion and to the upper-left portion of the windshield, respectively. On the other hand, similarly the two onboard antennas 1B (see FIG. 7) were provided and arranged in the right end portion and in the left end portion on the dashboard, respectively, and each ground element 30 was caused to extend along the left and right pillars of the vehicle body. The reception channel was TOKYO MX (physical channel: UHF band 20 ch, center frequency: 515 MHz, transmission output: 3 kW). The weather of the day when the field test was conducted was fine.

As the results of the field test, the way the block noise appeared in the video was substantially the same by the film antenna and by the onboard antenna 1B of the present disclosure in the residential streets around the Shinmaruko, Musashinakahara, and Musashishinjo. In contrast to this, in the section from the Tamagawa IC to the Keihin Kawasaki IC of the Daisan Keihin highway, in the area from Ishikawadai of National Route 312 to the Tamagawa IC, and in the area from Ishikawadai of National Route 311 to Shinmaruko, less block noise appeared by the onboard antenna 1B of the present disclosure. In other words, the reception characteristics more excellent than those of the film antenna were confirmed. Also in the case where the onboard antenna 1B of the present disclosure was disposed 10 cm apart from the pillar, it was possible to obtain substantially the same reception characteristics.

In other words, according to the present embodiment, the effect equivalent to that of the onboard antenna according to each embodiment described above is obtained and further, the reception characteristics of the antenna are further improved.

In the configuration illustrated in FIG. 7, the example is given in which the antenna element 10*a* is disposed on the side of the coaxial wire 40 and the second ground element 30*a* is disposed thereabove, but this is not limited and an arrangement opposite thereto may be accepted. In other words, the second ground element 30*a* may be disposed on the side of the coaxial wire 40 and the antenna element 10*a* may be disposed thereabove.

2-3. Modified Example 3

Figure 9:
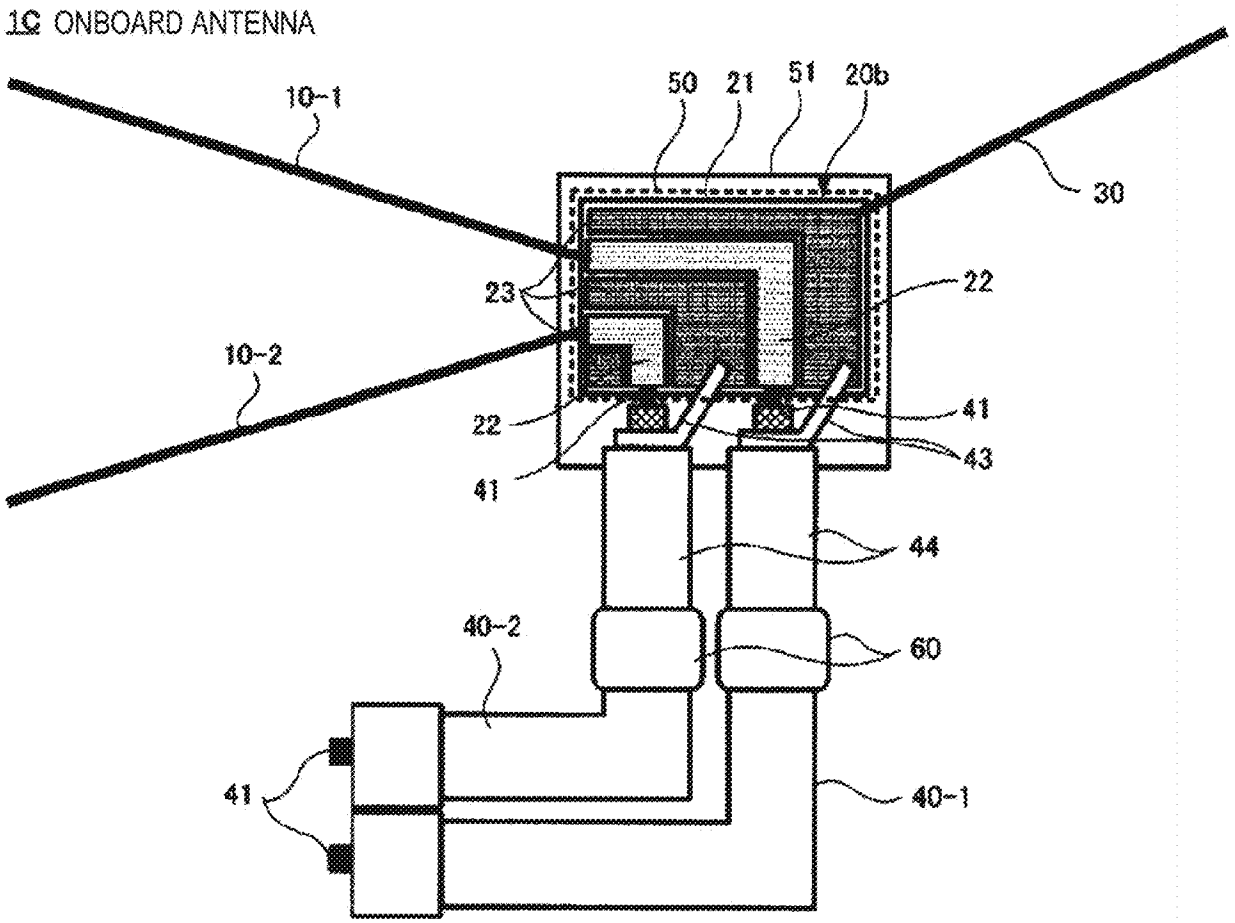
FIG. 9 is an explanatory diagram illustrating a configuration example of an onboard antenna according to a modified example 3 of the first embodiment of the present disclosure.

Next, a configuration example of an onboard antenna 1C according to a modified example 3 of the present embodiment is explained with reference to FIG. 9. In FIG. 9, the same symbols are attached to the portions corresponding to those in FIG. 1, FIG. 5, and FIG. 7 and duplicated explanation is omitted. The onboard antenna 1C illustrated in FIG. 9 has a configuration in which two antenna elements made of a linear metal member are provided and the second ground element 30 is shared by the two antenna elements. An antenna element 10-1 and an antenna element 10-2 are arranged so as to face in different directions so that the correlation of the reception state between the two antennas is as small as possible.

A substrate 21*b* is provided with two sets of the signal pattern 22 and the ground conductor 23 and the antenna element 10-1 and the antenna element 10-2 are connected to the different signal patterns 22, respectively. Then, on the side of the signal pattern 22 to which no antenna element is attached, a coaxial wire 40-1 for the antenna element 10-1 and a coaxial wire 40-2 for the antenna element 10-2 are provided separately.

With this configuration, even in the case where two antenna elements are necessary to perform diversity reception, it is only necessary to dispose the onboard antenna 1C on one side on the dashboard (not illustrated). Further, even in the case where diversity reception is performed using four antenna elements, it is only necessary to dispose the two onboard antennas 1C on both sides on the dashboard. According to the onboard antenna 1C of the present embodiment, it is possible to obtain the effect equivalent to the effect obtained in each embodiment described above.

In the present embodiment, the example is given in which the antenna element 10-1 and the antenna element 10-2 are configured by the same member (metal member), but this is not limited. For example, it may also be possible to form one of the two antenna elements by a substrate and to configure the other by a metal wire material. At this time, by arranging the antenna element configured by a substrate so as to be horizontal with respect to the dashboard and by configuring the other antenna element by a linear metal member and arranging the antenna element so as to stand vertically, it is possible to reduce the degree of correlation between both the antenna elements.

3. Second Embodiment Example

Figure 10:
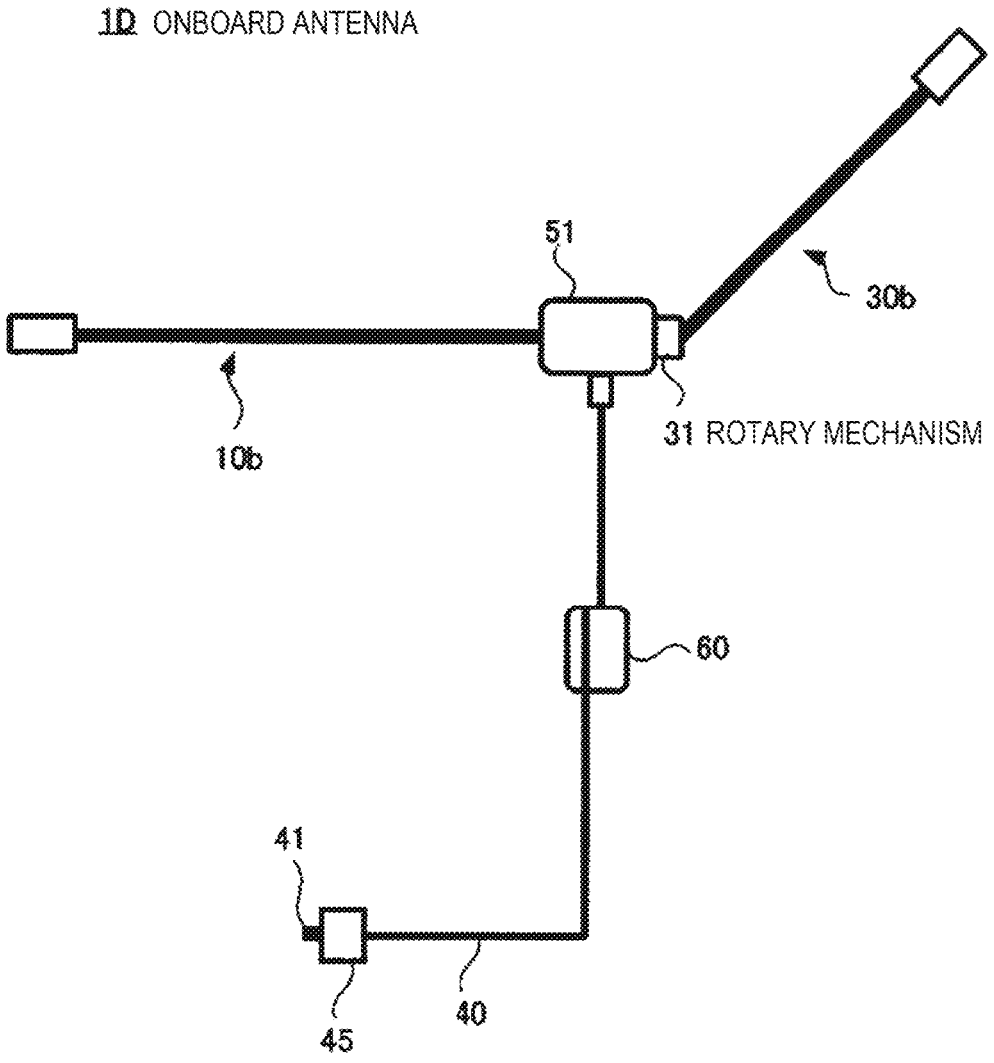
FIG. 10 is an explanatory diagram illustrating a configuration example of an onboard antenna according to a second embodiment of the present disclosure.

Next, a configuration example of an onboard antenna according to a second embodiment of the present disclosure is explained with reference to FIG. 10. In FIG. 10, the same symbols are attached to the portions corresponding to those in FIG. 1, FIG. 5, FIG. 7, and FIG. 9 and duplicated explanation is omitted. In an onboard antenna 1D according to the present embodiment, an antenna element 10*b* and a ground element 30*b* are configured by a rod antenna (rod-shaped antenna).

As the rod antenna caused to function as the ground element 30*b*, for example, a type in which the angle formed by the antenna portion and the support portion (relative position) may be adjusted to any angle is used. The antenna element 10*b* and the ground element 30*b* are connected via the high frequency transmission line (not illustrated) described above etc. and the connection portion is covered by a resin case. In the present embodiment, the connection portion of the ground element 30*b* and the substrate of the high frequency transmission line is provided with a rotary mechanism 31 including a earphone jack of ϕ 3.5 and by inserting the ground element 30*b* into the rotary mechanism 31, it is made possible to adjust the angle of the ground element 30*b* with respect to the antenna element 10*b* to any angle.

With this configuration, it is made possible to adjust the interval between the ground element 30*b* and the vehicle body (not illustrated) to any interval by rotating the ground element 30*b*. In other words, it is possible to dispose the ground element 30*b* in the position where the capacitive coupling that occurs between the ground element 30*b* and the vehicle body is the most appropriate, and therefore, it is made possible to easily improve the antenna characteristics. Further, it is possible to adjust the angle of the ground element 30*b* to any angle of the pillar with respect to the ground, and therefore, it possible to attach the onboard antenna 1D to any vehicle body. In the present embodiment, the example is given in which the rotary mechanism 31 is formed by the earphone jack, but this is not limited and it may also be possible to form the dedicated rotary mechanism 31. Alternatively, it is also possible to use a rod antenna configured so as to be capable of rotating, extending, and contracting, such as one used to watch and listen to a one-segment broadcast in the mobile phone.

3-1. Modified Example

Figure 11:
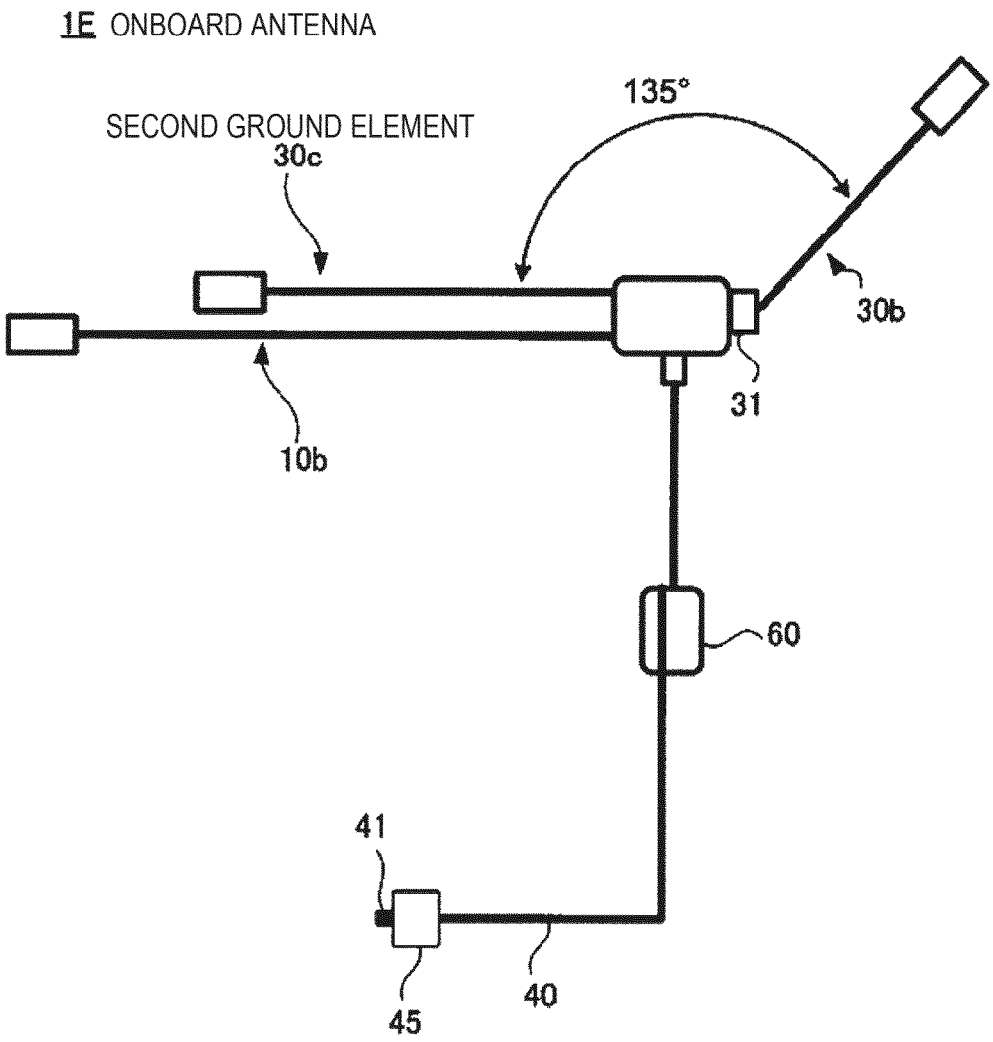
FIG. 11 is an explanatory diagram illustrating a configuration example of an onboard antenna according to a modified example of the second embodiment of the present disclosure.

It may also be possible to configure the onboard antenna 1D in which the antenna element 10*b* and the ground element 30*b* are configured by a rod antenna, illustrated in FIG. 10, as a J-type antenna. A configuration example of an onboard antenna 1E configured as described above is illustrated in FIG. 11. As in the configuration illustrated in FIG. 7, a second ground element 30*c* is provided separately from the ground element 30*b*. Then, the second ground element 30*c* is disposed in parallel to the antenna element 10*b* and separate from the antenna element 10*a* by a predetermined interval, and the length in the longitudinal direction thereof is made shorter than the length of the antenna element 10*b*.

With this configuration, it is made possible to cause the image current at the frequency received by the antenna element 10*a* to flow through the second ground element 30*c* and at the same time, to cause the current corresponding to the length of the ground element 30*c* to flow also on the antenna element side, and therefore, it is made possible to extend the band that can be received.

FIGS. 12A to 12C are a graph and tables showing the frequency-gain characteristics when the onboard antenna 1E (see FIG. 11) of the present embodiment receives a broadcast in the UHF band. The length of the ground element 30 is set to 120 mm and the length of the coaxial wire 40 is set to 1.5 m. Further, the length of the antenna element 10*b* is set to 130 mm, the length of the second ground element 30*c* is set to 85 mm, and the angle between the antenna element 10*b* and the second ground element 30*c* is set to 135°.

Figure 12:
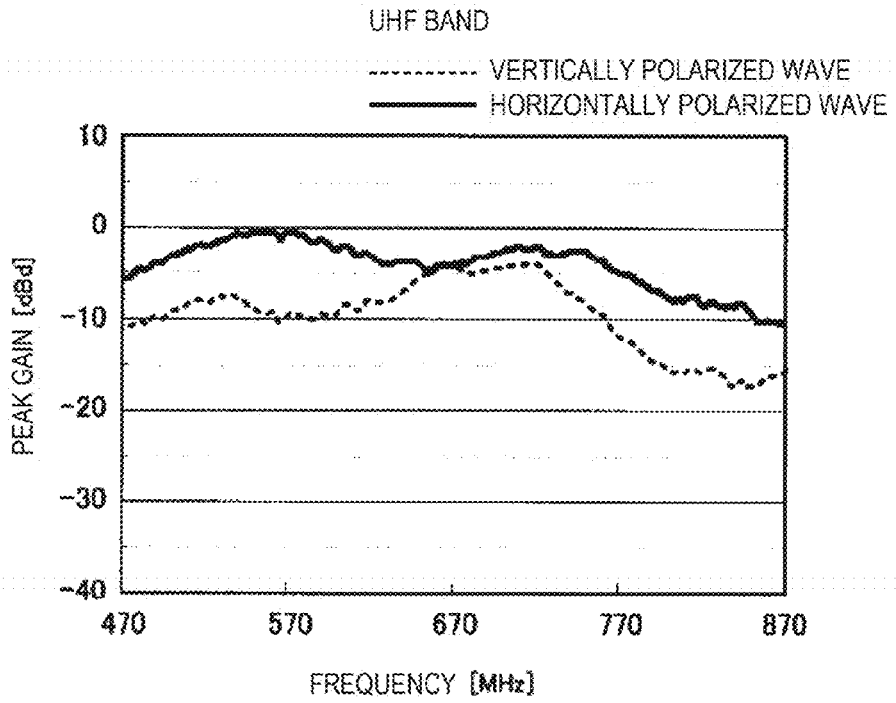

FIG. 12A is a graph and FIG. 12B and FIG. 12C illustrate data. The horizontal axis in FIG. 12A represents the frequency (MHz) and the vertical axis represents the peak gain (dBd). The solid line in the graph represents the gain characteristics at the time of reception of horizontally polarized waves and the broken line represents the gain characteristics at the time of reception of vertically polarized waves. FIG. 12B is data indicative of the frequency-gain characteristics at the time of reception of vertically polarized waves and FIG. 12C is data indicative of the frequency-gain characteristics at the time of reception of horizontally polarized waves. As illustrated in FIG. 12A to FIG. 12, particularly in the high frequency portion around 670 MHz to 750 MHz, it was confirmed that the gain characteristics of −8 dB or more were obtained both in the vertically polarized waves and in the horizontally polarized waves. In other words, although somewhat less excellent compared with the gain characteristics illustrated in FIGS. 8A to 8C, it is known that the characteristics more excellent than the reception characteristics in the other onboard antennas of the present disclosure are obtained, which are not configured into the J-type.

4. Various Kinds of Modified Examples

In each embodiment described above, the case where the onboard antenna 1 receives radio waves in the UHF band is taken as an example, but this is not limited. It is also possible to apply each embodiment to an antenna that receives, for example, the VHF band.

Further, in each embodiment described above, the example is given in which the onboard antenna 1 does not have an amplifier, but it may also be possible to provide an amplifier on the high frequency transmission line 20 configured as a coplanar line. By providing an amplifier, the front and the rear of the portion into which the amplifier is inserted are separated in terms of high frequencies, and therefore, it is no longer necessary to insert the ferrite core 60 into the coaxial wire 40.

Further, in each embodiment described above, the example is given in which the onboard antenna 1 and the navigation device, such as the PND 200, are connected via the coaxial wire 40, but the onboard antenna 1 may be incorporated inside the PND 200. For example, it may also be possible to design a configuration in which the antenna element is embedded in the portion etc. above the display screen on the case body and the ground element 30 is provided rotatably at the upper-right or upper-left portion of the case body.

Furthermore, in each embodiment described above, the example is given in which the onboard antenna 1 is connected to the navigation device, such as the PND 200, but this is not limited. It may also be possible to configure the onboard antenna 1 so as to be able to be attached to a portable device, such as a mobile phone terminal and a tablet terminal. In this case, it is only required to insert the ground element 30 into the terminal, for example, such as the Micro USB (USB micro terminal), and it may also be possible to use an antenna provided to the terminal as the standard device without providing the antenna element 10.

Additionally, the present disclosure may also be configured as below.

(1)

An antenna device including:

an antenna element configured to receive a broadcast wave and a signal that is superimposed on the broadcast wave and then is transmitted;

a ground element having a predetermined length, the ground element being configured to be capable of adjusting a relative position with respect to the antenna element; and a feeding part to which the antenna element and the ground element are connected and from which the signal received by the antenna element is taken out.

(2)

The antenna device according to (1), wherein the antenna element and the ground element are formed of a conductive member.

(3)

The antenna device according to (1) or (2), wherein the magnitude of a coupling capacitance of capacitive coupling that occurs between the ground element and a metal portion of a vehicle body of a vehicle in which the antenna device is installed changes in accordance with a relative position relationship between the ground element and the antenna element.

(4)

The antenna device according to any of (1) to (3), wherein the lengths of the antenna element and the ground element in a longitudinal direction are adjusted in a manner that the total length of the length of the antenna element and the length of the ground element is substantially $\lambda/2$ of a wavelength of a radio wave desired to be received.

(5)

The antenna device according to any of (1) to (4), further including:

a second ground element arranged substantially in parallel to the antenna element, the second ground element having a length shorter than the length of the antenna element and being connected to the feeding part.

(6)

The antenna device according to any of (1) to (4), wherein a coaxial wire is connected to the feeding part, and the antenna device further includes a second antenna element different from the antenna element.

(7)

The antenna device according to any of (1) to (6), wherein the antenna element and the second antenna element are arranged in a manner that the antenna element and the second antenna element face in mutually different directions.

(8)

The antenna device according to any of (1) to (7), wherein the antenna element is connected to a conductive part of a substrate having the conductive part and a ground part, the conductive part of the substrate includes a first conductive part for the antenna element and a second conductive part for the second antenna element, the first conductive part is connected to the coaxial wire, and the second conductive part is connected to a second coaxial wire different from the coaxial wire.

(9)

The antenna device according to any of (1) to (4), wherein a coaxial wire is connected to the feeding part, and a high frequency attenuating part configured to attenuate a high frequency current is provided on a part of the coaxial wire.

(10)

The antenna device according to any of (1) to (4), wherein the antenna element is connected to a conductive part of a substrate having the conductive part and a ground part, and the ground element is connected with the ground part of the substrate.

(11)

The antenna device according to any of (1) to (4), wherein the antenna element is connected to a core wire of the coaxial wire, and the ground element is connected to an external conductor of the coaxial wire.

REFERENCE SIGNS LIST

1, 1A, 1B, 1C, 1D, 1E onboard antenna
10, 10-1, 10-2, 10*a*, 10*b* antenna element
20 high frequency transmission line
21 substrate
22 signal pattern
23 ground conductor
24 slit
30 ground element
30*a* second ground element
30*b* ground element
30*c* second ground element
31 rotary mechanism
40 coaxial wire
40-1, 40-2 coaxial wire
41 core wire
42 dielectric
43 external conductor
44 protective covering
45 coaxial connector
50 connection part
51 resin
51*a* resin case
60 ferrite core
101 windshield
102 dashboard
200 PND
210 receiver
220 display unit

The invention claimed is:

1. An antenna device comprising:

an antenna element arranged exterior to and adjacent to a bottom base of a windshield in a vehicle body and configured to receive a broadcast wave and a signal that is superimposed on the broadcast wave; and a ground element having a predetermined length, the ground element being configured to be capable of adjusting a relative position with respect to the antenna element and with respect to the vehicle body;

wherein the magnitude of a coupling capacitance that occurs between the ground element and a metal portion of the vehicle body in which the antenna device is installed depends on a relative position relationship between the ground element and the antenna element.

2. The antenna device according to claim 1, wherein the lengths of the antenna element and the ground element in a longitudinal direction are adjusted in a manner that the total length of the length of the antenna element and the length of the ground element is substantially $\lambda/2$ of a wavelength of a radio wave desired to be received.

3. The antenna device according to claim 2, further comprising:

a feeding part to which the antenna element and the ground element are connected and from which the signal received by the antenna element is taken out; and a second ground element arranged substantially in parallel to the antenna element, the second ground element having a length shorter than the length of the antenna element and being connected to the feeding part.

4. The antenna device according to claim 2, wherein a coaxial wire is connected to the feeding part, and the antenna device further comprises a second antenna element different from the antenna element.

5. The antenna device according to claim 4, wherein the antenna element and the second antenna element are arranged in a manner that the antenna element and the second antenna element face in mutually different directions.

6. The antenna device according to claim 5, wherein the antenna element is connected to a conductive part of a substrate having the conductive part and a ground part, the conductive part of the substrate includes a first conductive part for the antenna element and a second conductive part for the second antenna element, the first conductive part is connected to the coaxial wire, and the second conductive part is connected to a second coaxial wire different from the coaxial wire.

7. The antenna device according to claim 2, wherein a high frequency attenuating part configured to attenuate a high frequency current is provided on a part of the coaxial wire.

8. The antenna device according to claim 2, wherein the antenna element is connected to a conductive part of a substrate having the conductive part and a ground part, and the ground element is connected with the ground part of the substrate.

9. The antenna device according to claim 2, wherein the antenna element is connected to a core wire of the coaxial wire, and the ground element is connected to an external conductor of the coaxial wire.

* * * * *